United States Patent [19]

O'Malley et al.

[11] 4,012,009

[45] Mar. 15, 1977

[54] TEXTILE BEAM

[75] Inventors: Arthur S. O'Malley; Eli G. Byrum, Jr., both of Charlotte, N.C.

[73] Assignee: Hayes-Albion Corporation, Charlotte, N.C.

[22] Filed: Oct. 24, 1975

[21] Appl. No.: 625,468

[52] U.S. Cl. ..... 242/118.62

[51] Int. Cl.[2] ..... B65H 75/14

[58] Field of Search ..... 242/118.62, 118.61, 242/118.6, 118.4, 77.3, 77.4, 77, 118.8, 118.7

[56] References Cited

UNITED STATES PATENTS

| | | | |
|---|---|---|---|
| 2,837,297 | 6/1958 | Moss | 242/118.62 |
| 3,104,851 | 9/1963 | Portal | 242/118.62 |
| 3,596,850 | 8/1971 | McMurtie | 242/118.62 |

*Primary Examiner*—George F. Mautz

[57] ABSTRACT

In a textile beam consisting of a pair of heads threaded onto the ends of a cylindrical barrel, relative rotation between a head and the barrel is restrained by providing on the head a plurality of screws which extend parallel to the axis of the barrel and engage threads on the head, and which are turnable into abutment with a thrust ring carried by the barrel, thereby creating an axial separating force between the head and the barrel which increases the friction in the threads connecting these two parts together.

9 Claims, 5 Drawing Figures

FIG. 1
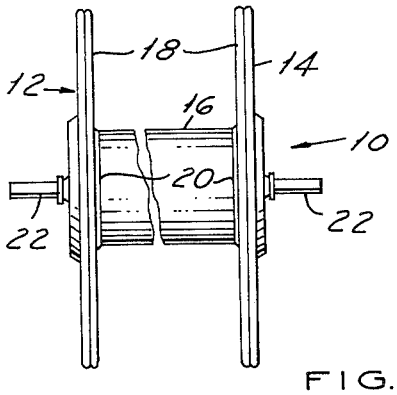
FIG. 3
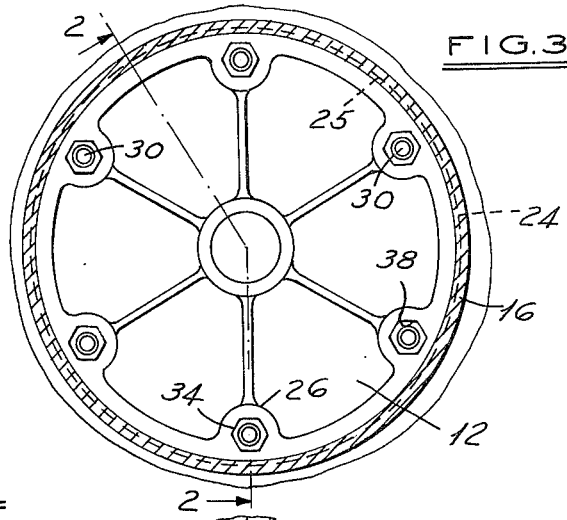
FIG. 5
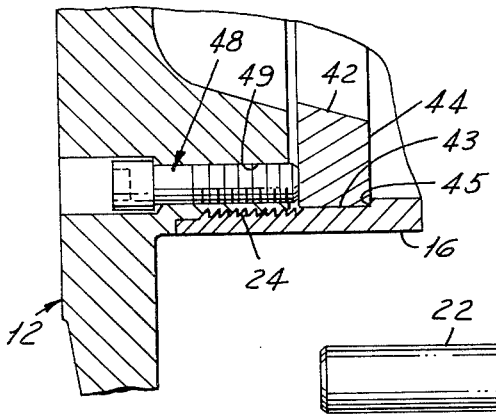
FIG. 4
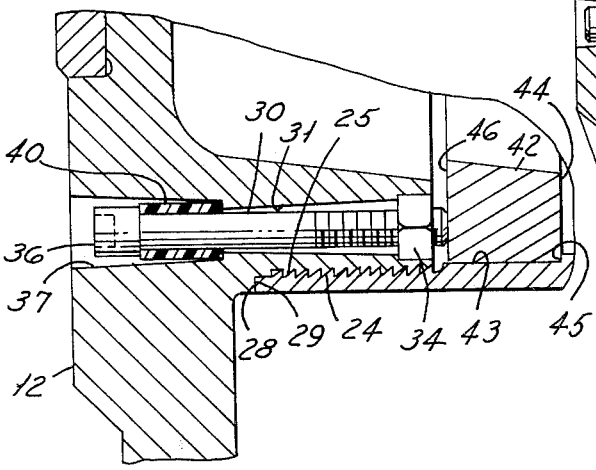
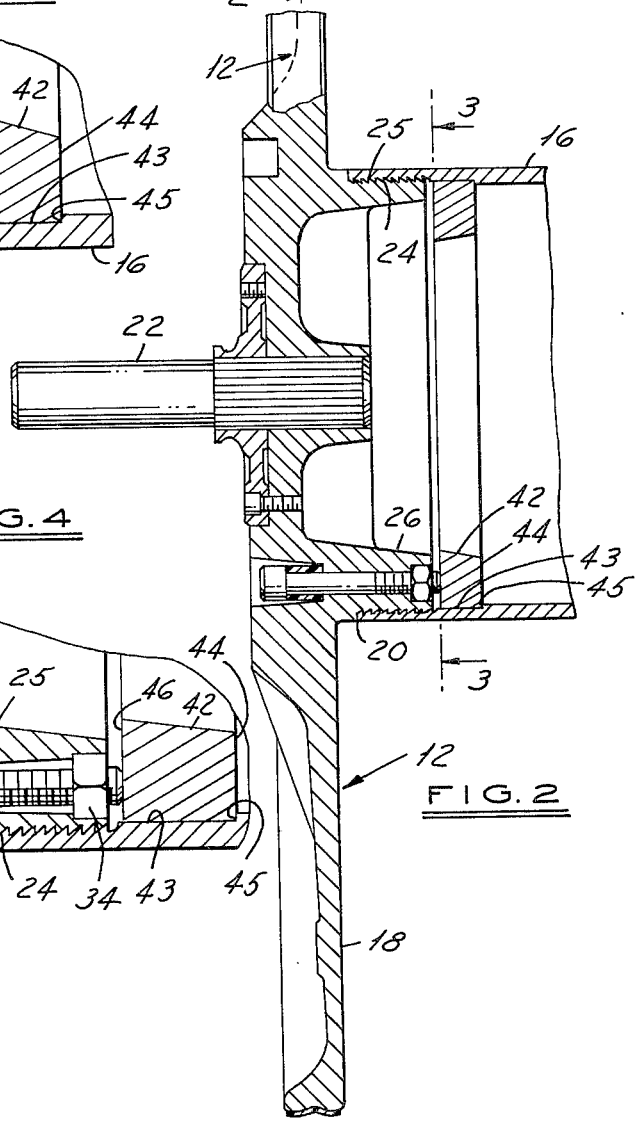
FIG. 2

TEXTILE BEAM

This invention relates to improvements in the construction of textile beams, and particularly to improved retaining means for preventing relative rotational movement between the head and the barrel of a textile beam connected together by interengaging threaded portions.

It has been common practice to connect the heads and the barrel of a textile beam together by threads, usually in the form of internally threaded portions provided at the ends of the barrel engaged by externally threaded portions on the heads. It is also common practice to employ an interference fit between these threaded portions on the barrel and the heads in order to prevent the possibility of relative rotation between a head and the barrel when the beam is used in textile operations which frequently require severe braking forces to be applied to the heads of a beam. The practice of employing an interference fit between the threaded portions has been satisfactory, but it does require specialized equipment and techniques in order to properly assemble the heads and barrel and to disassemble these parts in the event repairs or replacement become necessary. Consequently, repairs involving such a disassembly and reassembly operation usually require that the damaged beam be sent back to the manufacturer, with the obvious disadvantages of lost time and increased expense involved in this type of repair operation.

The present invention provides an improved threaded connection between the head and barrel of a beam. A normal rather than an interference fit is employed for the interengaging threaded portions so that a relatively low amount of torque is required to turn a head onto or off of a barrel, and retaining means carried by the head and the barrel are provided for applying a separating force therebetween in a direction generally parallel to the axis of the barrel, which force increases the frictional resistance in the threaded portions to relative rotational movement between the head and the barrel.

Preferably, the retaining means comprises a plurality of screws engaging threads in the head and extending axially toward an annular thrust ring mounted within the barrel, the screws being turnable into engagement with the thrust ring to thereby create the aforementioned axial separating force.

Other features and advantages of the invention will be apparent from the description to follow of the representative embodiments thereof disclosed in the accompanying drawings.

DESCRIPTION OF THE DRAWINGS

FIG. 1 is an elevation of a representative beam consisting of a barrel and a pair of heads;

FIG. 2 is an enlarged sectional elevation, taken as indicated by the line 2—2 of FIG. 3, showing a head connected to one end of a barrel by the construction of the invention;

FIG. 3 is a sectional elevation taken as indicated by the line 3—3 of FIG. 2;

FIG. 4 is an enlarged sectional detail showing the retaining means of the invention; and FIG. 5 is a sectional view similar to FIG. 4 but showing an alternative construction.

DESCRIPTION OF THE PREFERRED EMBODIMENTS

A textile beam 10, as shown in FIG. 1, consists of a pair of heads 12 and 14, each connected to one end of a tubular cylindrical barrel 16. The heads 12 and 14 provide a pair of oppositely facing yarn retaining surfaces 18; the joints between the heads and barrel are indicated by the lines 20, which joints must be closed and non-separable so that yarn cannot become trapped therein; and, the beam 10 is rotatable about the axis of the cylindrical barrel 16 on spindles 22.

FIGS. 2–4 illustrate the connection of one of the heads 12 to one end of the barrel 16, it being understood that the other head 14 would ordinarily be connected in the same manner. An internal threaded portion 24 formed on the barrel 16 is engaged by an external threaded portion 25 formed on the hub 26 of the head 12. For example, an eight pitch buttress thread may be employed on these threaded portions 24 and 25, using a normal or non-interference fit between the threads. When the head 12 is mounted on the barrel 16, these parts are relatively rotated by engagement between their threaded portions 24 and 25 until the end 28 of the barrel 16 abuts firmly against a radial shoulder 29 provided on the head to form the closed, non-separable joint 20 mentioned above. In the construction shown, the surfaces 28 and 29 of the joint 20 extend radially of the beam axis; however, in other constructions, these surfaces may extend angularly to the yarn face 18 to decrease the possibility of separation under load, as taught by U.S. Pat. No. 3,317,160 owned by the assignee of the present invention.

Textile operations occassionally require a rotating beam to be suddenly stopped by the application of braking forces to the beam heads, and the resulting torque tends to produce relative rotation in a disassembling direction between at least one of the heads and the barrel. Such relative rotation is resisted in the present invention by retaining means carried by the head 12 and the barrel 16 for applying a separating force therebetween in a direction generally parallel to the axis of the barrel 12 which force increases the frictional resistance in the threaded portions 24 and 25 to relative rotational movement between the head 12 and the barrel 16. In the construction shown in FIGS. 2–4, the retaining means comprises a plurality of retaining members, or bolts 30, spaced circumferentially around the hub 26 of the head radially inward of the threaded portion 25. Each bolt 30 extends parallel to the beam axis through a bore 31 in the head 12 and includes threads 32 engaging a nut 34, and a cap 36 located within an enlarged recess 37 formed as part of the bore 31. The nut 34 is seated in a complimentary shaped socket 38 and thereby held against turning, and a resilient retainer or spacer 40 mounted between the cap 36 of the bolt 30 and the bottom of the recess 37 acts to normally urge the bolt 30 in a direction such as to retain the nut 34 seated in the socket 38. The retaining members 30 are turnable into engagement with abutment means in the form of a thrust ring 42 carried by the barrel 16 and positioned in a counterbore 43 formed internally on the barrel 16 inwardly of the threaded portion 24, the inner end 44 of the thrust ring 42 seating against a radial shoulder 45 at the inner end of the counterbore.

An alternative construction of the retaining means shown in FIG. 5 is similar except that the retaining members are screws 48, each of which engages a threaded hole 49 in the head 12.

To assemble the head 12 and barrel 16, a thrust ring 42 is slipped into the barrel counterbore 43 and the head 12 and barrel 16 are relatively rotated to engage their threaded portions 25 and 24 and close their joint 20, the retaining members 30 or 48 being positioned so as to not interfere with this assembly operation by engaging the thrust ring 42. The retaining members are then turned inwardly into abutment with the radial face 46 of the thrust ring 42 and are tightened, thereby creating an axial separating force between the barrel 16 and the head 12 which greatly increases the frictional resistance in the threaded portions 24 and 25 to relative rotation between the head and barrel. For example, in a test of a prototype beam such as shown in FIGS. 2–4 having a barrel diameter of 11.75 inches and normally fitted eight-pitch buttress threads, approximately 900 ft. lbs. of torque was required to turn the head in a disassembling direction without the retaining means. Using three ½ inch retaining bolts 30 spaced circumferentially as shown in FIG. 3 and tightened against the thrust ring 42 to the torque recommended for this size bolt, the torque required to turn the head was increased to approximately 4,750 ft. lbs. which is well above that encountered in the most severe braking conditions. Releasing the retaining means reduces the disassembly torque requirement to the 900 ft. lb. level at which disassembly and reassembly of the head and barrel can readily be accomplished.

The use of buttress type threads on the portions 24 and 25 of the head and barrel is preferred because the separating force created by the retaining means is resisted by generally radially extending thread surfaces so that spreading of the barrel and separation of the joint 20 is avoided.

We claim:

1. In a textile beam including a tubular cylindrical barrel and a pair of heads each attached to one of the ends of the barrel by engagement between threaded portions provided on the head and the barrel, the improvement comprising retaining means positioned radially inwardly of said threaded portions on the head and the barrel for applying a separating force therebetween in a direction generally parallel to the axis of the barrel, said force increasing the frictional resistance in said threaded portions to relative rotational movement between said head and barrel.

2. A textile beam according to claim 1 wherein said retaining means comprises at least one retaining member carried by the head and movable toward the barrel, and abutment means carried by the barrel, said abutment means being engageable by said retaining member.

3. A textile beam according to claim 1 wherein said retaining means comprises a plurality of retaining members threadedly carried by said head for movement axially toward and away from the barrel.

and abutment means carried by the barrel, said abutment means being engageable by said retaining members on movement thereof toward the barrel.

4. A textile beam according to claim 3 wherein said abutment means comprises a thrust ring carried internally of the barrel.

5. A textile beam according to claim 4 wherein the barrel is provided with an internal shoulder engageable by said thrust ring.

6. A textile beam according to claim 1 wherein said threaded portions comprise an internally threaded portion on the barrel and an externally threaded portion on the head, and said retaining means comprise a shoulder formed internally on the barrel inwardly of said internally threaded portion, a thrust ring carried by the barrel inwardly of said internally threaded portion and seated against said shoulder, a plurality of circumferentially spaced threaded retaining members carried by the head radially inwardly of said externally threaded portion, said retaining members extending axially toward the barrel, and thread means on the head engaged by said retaining members whereby said retaining members can be turned into abutting engagement of their inner ends with said thrust ring.

7. A textile beam according to claim 6 wherein said thread means comprise a plurality of nuts each engaged by one of said retaining members and each non-rotatably fitted in a socket formed in the head.

8. A textile beam according to claim 7 further comprising means resiliently urging each retaining member in a direction such as to maintain engagement between said nut and said socket.

9. A textile beam according to claim 1 wherein said retaining means comprises at least one retaining member and abutment means engageable thereby.

* * * * *